US009208701B2

(12) United States Patent
Breihof

(10) Patent No.: US 9,208,701 B2
(45) Date of Patent: Dec. 8, 2015

(54) SIGN ASSEMBLY

(71) Applicant: SignComp, LLC, Grand Rapids, MI (US)

(72) Inventor: Thomas C. Breihof, Belmont, MI (US)

(73) Assignee: SignComp, LLC, Grand Rapids, MI (US)

( * ) Notice: Subject to any disclaimer, the term of this patent is extended or adjusted under 35 U.S.C. 154(b) by 55 days.

(21) Appl. No.: 14/215,535

(22) Filed: Mar. 17, 2014

(65) Prior Publication Data

US 2014/0259827 A1 Sep. 18, 2014

Related U.S. Application Data

(60) Provisional application No. 61/791,210, filed on Mar. 15, 2013.

(51) Int. Cl.

| | |
|---|---|
| ***G09F 15/00*** | (2006.01) |
| ***G09F 7/00*** | (2006.01) |
| ***G09F 19/22*** | (2006.01) |
| *G09F 13/04* | (2006.01) |

(52) U.S. Cl.

CPC ..... *G09F 7/002* (2013.01); *G09F 15/0012* (2013.01); *G09F 15/0018* (2013.01); *G09F 19/22* (2013.01); *G09F 13/0404* (2013.01)

(58) Field of Classification Search

CPC ..... G09F 15/0012; G09F 7/00; G09F 7/18; G09F 15/00; G09F 21/04; G09F 13/00; G09F 13/04; G09F 2013/045; E04H 13/003

See application file for complete search history.

(56) References Cited

U.S. PATENT DOCUMENTS

| | | | | | |
|---|---|---|---|---|---|
| 4,169,327 | A | * | 10/1979 | Stilling | 40/549 |
| 4,516,343 | A | * | 5/1985 | Stilling | 40/574 |
| 4,542,605 | A | | 9/1985 | Gandy | |
| 4,554,754 | A | * | 11/1985 | Stilling | 40/603 |
| 4,937,961 | A | | 7/1990 | Gandy et al. | |
| 5,020,254 | A | * | 6/1991 | Sheppard | 40/603 |
| 5,033,216 | A | | 7/1991 | Gandy et al. | |
| 5,255,459 | A | | 10/1993 | Verret | |
| 5,353,536 | A | * | 10/1994 | Erber et al. | 40/606.1 |
| 5,467,546 | A | | 11/1995 | Kovalak, Jr. | |
| 5,992,070 | A | * | 11/1999 | Birnbaum | 40/603 |
| 6,061,941 | A | | 5/2000 | Verret | |
| 6,070,351 | A | | 6/2000 | Verret | |
| 6,073,376 | A | | 6/2000 | Verret | |
| 7,448,154 | B1 | * | 11/2008 | Kludt | 40/446 |
| 8,595,966 | B2 | | 12/2013 | Breihof | |
| 2012/0124874 | A1 | | 5/2012 | Breihof | |

FOREIGN PATENT DOCUMENTS

| | | |
|---|---|---|
| CA | 2159368 | 5/2002 |

* cited by examiner

*Primary Examiner* — Casandra Davis

(74) *Attorney, Agent, or Firm* — Gardner, Linn, Burkhart & Flory, LLP

(57) ABSTRACT

An outdoor sign assembly includes a perimeter framework with fluid-directing channels to direct water off of the sign during inclement weather, and further includes individually removable sign face panels that are configured to support individual indicia members including lettering, numbers, symbols, designs, or the like, including internally-lighted indicia. The sign face panels cooperate with the framework to direct water around and off of the sign assembly, and may be placed in side-by-side arrangement to achieve any desired length. During assembly or disassembly, the sign face panels are held relatively securely to the framework, even before mechanical fasteners are fully tightened.

20 Claims, 6 Drawing Sheets

SIGN ASSEMBLY

CROSS REFERENCE TO RELATED APPLICATION

The present application claims the benefit of U.S. Provisional Application Ser. No. 61/791,210, filed Mar. 15, 2013, which is hereby incorporated herein by reference in its entirety.

FIELD OF THE INVENTION

The present invention is directed to signage and, more specifically, to signs mounted in outdoor environments such as along exterior walls or façades of buildings.

BACKGROUND OF THE INVENTION

Outdoor display signs are used for advertising businesses and providing other useful information to customers or other persons within view of the signs. Such signs may include a plurality of separate letters or other indicia, for example, or may include printed sections with words, symbols, or designs, and in some cases may be internally-lighted using low or high voltage lighting. However, outdoor display signs, which may typically be fastened to exterior surfaces of buildings or the like, are also exposed to weather including rain and other forms of moisture that can cause damage in various forms. In addition, typical outdoor display signs require significant disassembly in order to service even relatively small portions of the signs.

SUMMARY OF THE INVENTION

The present invention provides a weather-resistant sign assembly that can permanently or semi-permanently support substantially any indicia for display, such as lettering or other characters, symbols or other designs, printed graphics, internally-lighted indicia, or the like. The sign assembly is configured to channel and direct water through and around a framework of the sign assembly, substantially without entrapping water or other forms of moisture that could damage the sign by enabling the formation of mildew, interfering with the safe and reliable operation of electrical components of the sign, corroding fasteners, etc. The sign assembly is also designed for serviceability, so that only portions of the sign in need of service may be partially disassembled in order to conduct the service, without need for disassembling unaffected portions of the sign.

According to one form of the present invention, a weather-resistant sign assembly includes a generally rectangular framework made up of a plurality of perimeter frame members, at least two sign face panels, an elongate vertical channel member, and a plurality of fasteners for securing the sign face panels to the framework. The perimeter frame members typically include at least an upper frame member, a lower frame member, a left frame member, and a right frame member, each of the frame members having a respective elongate, fluid-conducting channel formed lengthwise therein, and an elongate slot defined along an outboard surface of each of the perimeter frame members, the elongate slot being open to the fluid-conducting channel. The sign face panels include at least left and right panels that are positioned along and in front of the perimeter frame members in side-by-side arrangement. Each of the sign face panels has a forward-facing central display portion, respective left, right, top, and bottom edge regions that are angled rearwardly from the forward-facing central display portion, and a downwardly-angled hook portion at a distal end of the top edge region. The elongate vertical channel member has an upper and lower end portions that are coupled to the upper and lower frame members, respectively. The channel member defines a forward-facing and substantially vertical channel that is aligned with and configured to simultaneously receive respective distal edges of the right edge region of the left sign face panel and the left edge region of the right sign face panel. The fasteners are movably positioned at the bottom edge regions of the left and right sign face panels, and are moveable between a fastening position in which distal end portions of the fasteners extend into the fluid-conducting channel of the lower frame member, and a releasing position in which the distal end portions of the fasteners substantially disengage the fluid-conducting channel of the lower frame member. In this manner, the left and right sign face panels may be secured to the framework when the downwardly-angled hook portions of the left and right sign face panels are received in the fluid-conducting channel of the upper frame member, and the distal end portions of the fasteners are in their fastening positions.

In one aspect, the sign assembly further includes a channel gasket that is positioned or disposed in the substantially vertical channel of the vertical channel member. The channel gasket is compressed between a portion of the vertical channel member and the distal edge of the right edge region of the left sign face panel and the distal edge of the left edge region of the right sign face panel. Thus, the channel gasket can limit or prevent water that enters the substantially vertical channel from escaping past the vertical channel member.

In another aspect, the upper frame member includes a generally L-shaped forward portion having a first leg extending in an outboard direction, and a second leg extending in a rearward direction from a distal end portion of the first leg portion. Optionally, a perimeter gasket is disposed at the generally L-shaped forward portion of the upper frame member, so that the perimeter gasket is engaged by the top edge regions of the left and right sign face panels near the elongate vertical channel member. Optionally, the perimeter gasket is generally L-shaped with first and second legs that generally correspond to the first and second legs of the L-shaped forward portion of the upper frame member.

In still another aspect, the sign assembly includes a backing panel for attachment to a generally vertical support surface, such as the exterior wall or façade of a building. In this arrangement, each of the frame members includes a rear portion configured to engage the backing panel. Optionally, the backing panel is a generally planar member that is mounted substantially parallel to the generally vertical support surface.

In a further aspect, the sign assembly further includes a plurality of indicia members that are coupled to the forward-facing central display portions of the left and right sign face panels. Optionally, the indicia members include at least one chosen from (i) lettering, (ii) symbols, and (iii) internally-lighted indicia. The indicia members may be coupled to the forward-facing central display portions via mechanical fasteners, for example.

In a still further aspect, the perimeter frame members and the elongate vertical channel member are extruded sections that are configured to be cut to a desired length. Optionally, the perimeter frame members and the elongate vertical channel member are made of extruded aluminum. Optionally, the sign face panels are made from formed sheet aluminum.

Accordingly, the sign assembly of the present invention permits the display of substantially any sign or other indicia, which is resistant to damage or the buildup of moisture due to weather, and which is also readily serviced in portions, such as for replacing electrical components or changing sign lettering or other indicia, without need for disassembling and/or removing those portions of the sign that do not require service. The sign assembly is built with a framework having water channels for directing water away from the sign, and with gaskets to ensure that water or other forms of moisture do not enter into portions of the sign assembly where the moisture could become trapped and cause damage.

These and other objects, advantages, purposes, and features of the invention will become more apparent upon review of the following specification in conjunction with the drawings.

DESCRIPTION OF THE PREFERRED EMBODIMENTS

The present invention provides a weather-resistant sign assembly for supporting substantially any indicia for display, typically on an exterior surface of a building. The sign assembly may be used as a backing or mounting surface for substantially any form of indicia for display, such as lettering or other characters, symbols or other designs, printed graphics, internally-lighted characters, or the like. As will be described in detail below, the sign assembly includes a framework that is substantially weather-resistant and configured to substantially limit or prevent the buildup of moisture. The sign assembly is also relatively simple to maintain, such as by permitting individual portions of the sign assembly to be serviced without disturbing other portions that do not require service.

Throughout this specification, the terms "left", "right", "upper" or "top", "lower" or "bottom", "front" or "forward", and "rear" or "back", are used to denote relative directions as seen by a viewer facing the sign assembly from a normal viewing position. The term "outboard" is used herein to refer to any direction that is generally outward from the center of the sign, and the term "inboard" is used to refer to any direction that is generally inward toward the center of the sign. Such terms are used for clarity of description, and should not be construed as limiting in any way.

Figures 1, 1A:
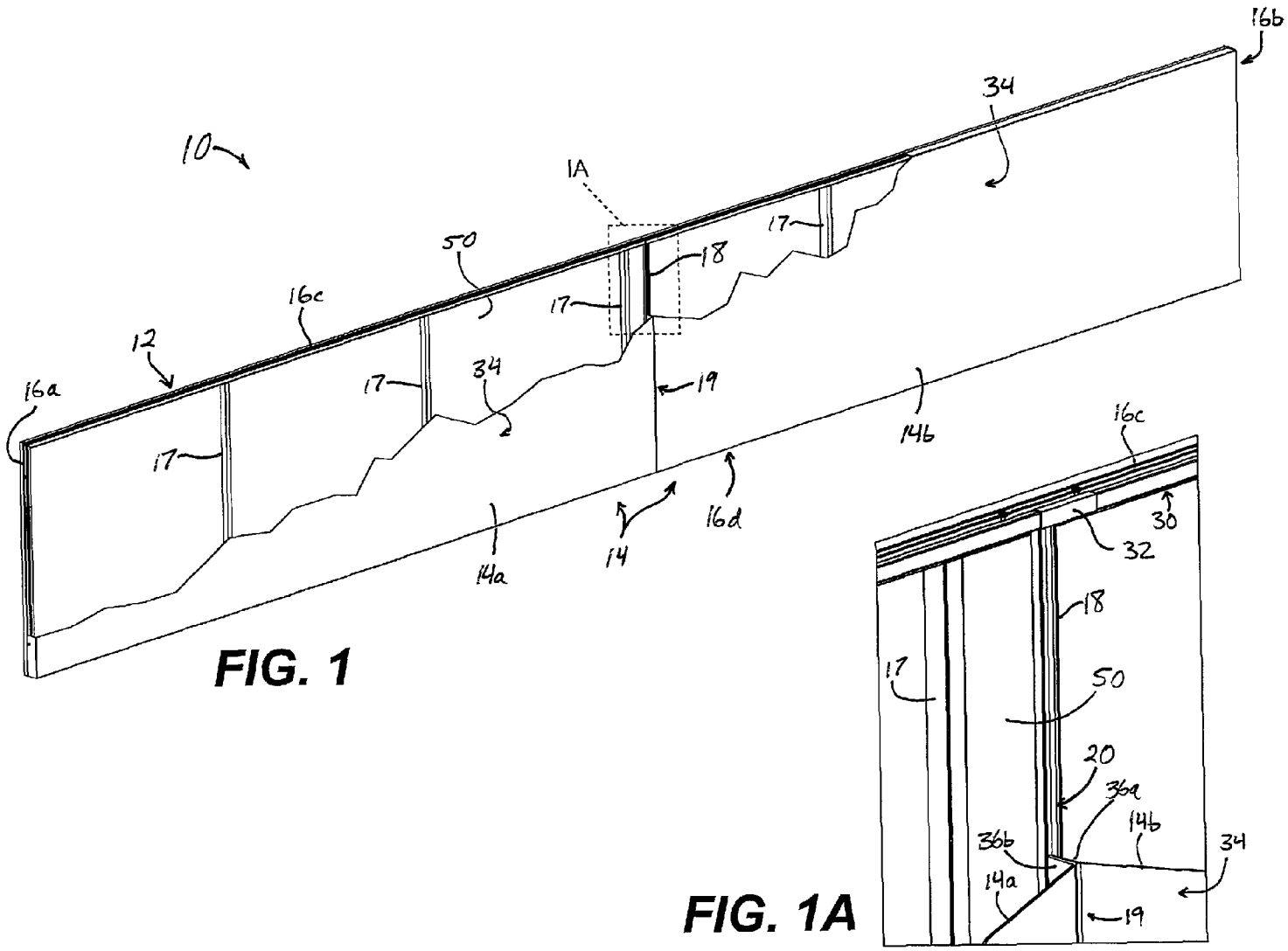
FIG. 1 is a front perspective view of a sign assembly in accordance with the present invention, with portions of the sign face panels cut away to show interior detail.
FIG. 1A is an enlarged view of the area designated IA in FIG. 1.
Figure 2:
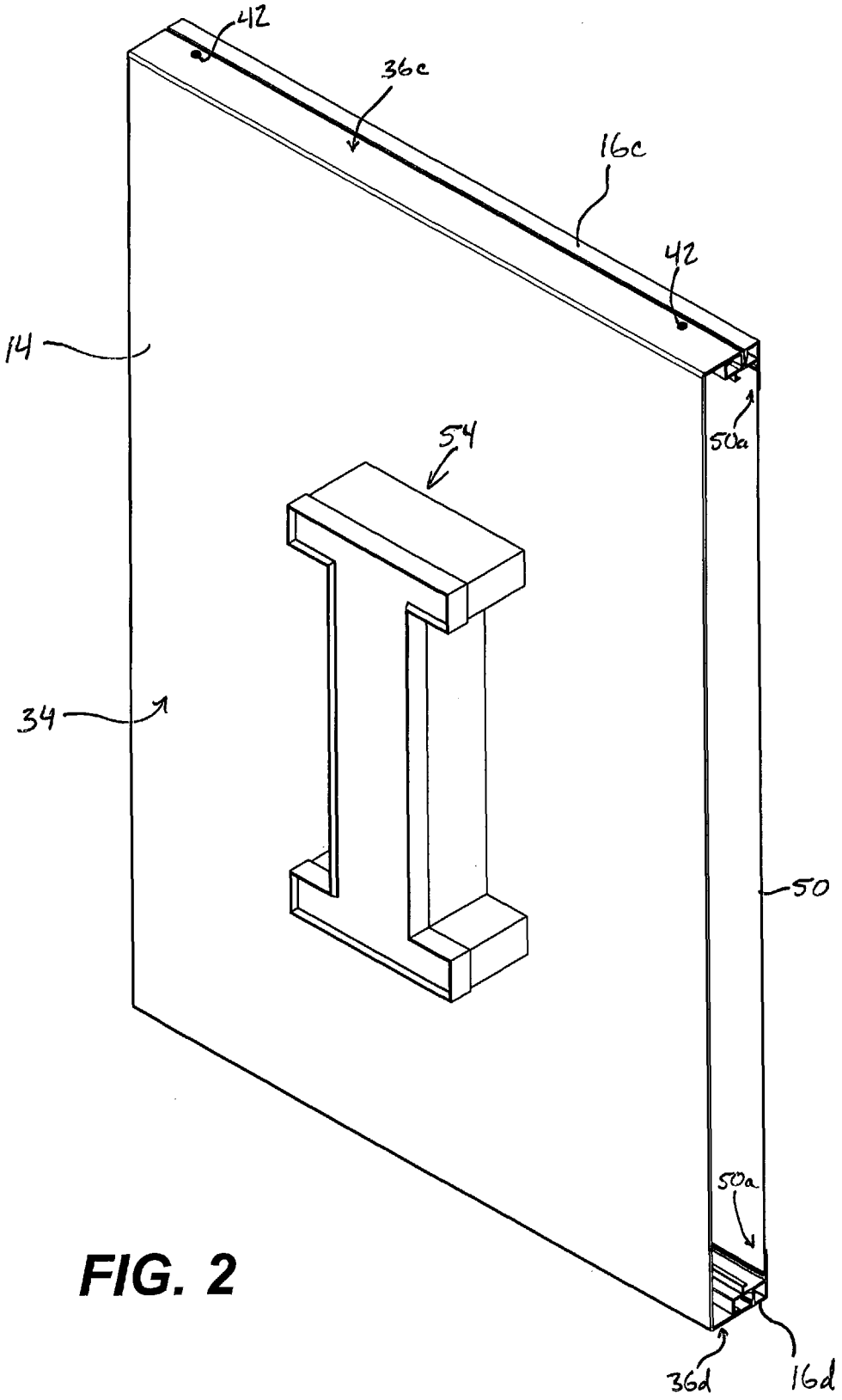
FIG. 2 is a perspective view of a middle portion of a sign assembly like that of FIG. 1, shown with an indicia letter coupled to a sign face panel.
Figure 3:
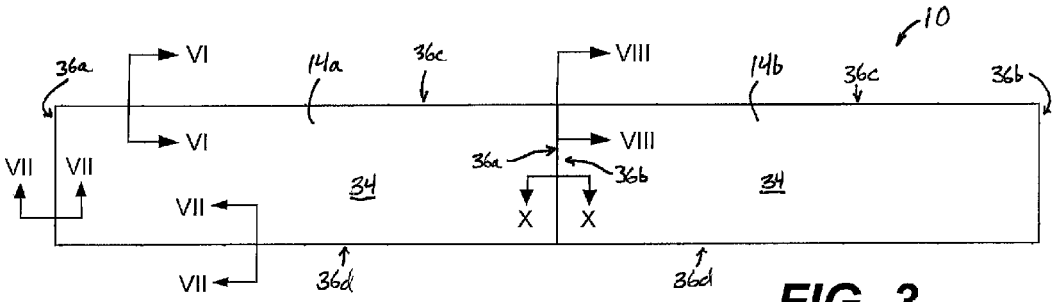
FIG. 3 is a front elevation the sign assembly of FIG. 1, in which the complete sign face panels are shown.

Referring now to the drawings and the illustrative embodiments depicted therein, a weather-resistant outdoor sign assembly 10 includes a framework 12 that supports at least one (and typically two or more) sign face panels 14 in side-by-side arrangement, such as shown in FIGS. 1 and 3. In the illustrated embodiment, sign face panels 14 include a left sign face panel 14*a* and a right sign face panel 14*b*, although it is envisioned that substantially any number of sign face panels 14 may be placed in side-by-side arrangement along an appropriately-sized framework, to provide a finished sign assembly having substantially any desired dimensions. Sign face panels 14 are configured to support various forms of indicia or indicia members, such as lettering (FIG. 2), numbers, symbols, or printed designs, any of which may be internally lighted, such as in a known manner.

Framework 12 is generally rectangular in shape, and is made up of a plurality of perimeter frame members including a left frame member 16*a*, a right frame member 16*b*, an upper frame member 16*c*, and a lower frame member 16*d* (FIG. 1). Although primarily shown and described herein as a rectangular frame, other, non-rectangular shapes are also envisioned. For example, triangles or other polygons may be possible, as well as omitting the lower frame members to form an inverted U-shaped frame, for example. In the illustrated embodiment, each of the frame members 16*a-d* (collectively referred to hereinafter as "frame members 16") is an extruded section having the same cross-section profile as each of the other frame members 16 for simplicity and economy, although it will be appreciated that different profiles for the different frame members are also possible, without departing from the spirit and scope of the present invention. Frame members 16 are joined to one another at their respective ends via welding, bonding, mechanical fasteners, or the like, to form the generally rectangular framework 12. Optionally, and as shown in FIGS. 1 and 1A, one or more intermediate frame members 17 may be coupled between upper frame member 16*c* and lower frame member 16*d* to provide added structural rigidity to framework 12.

Figure 4:
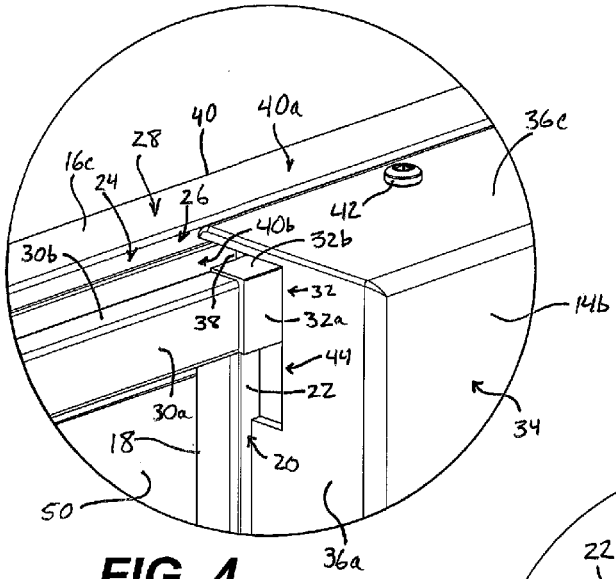
FIG. 4 is an enlarged perspective view of a top-middle portion of the sign assembly of FIG. 3, in which the left sign face panel is removed to show additional structure.
Figure 5:
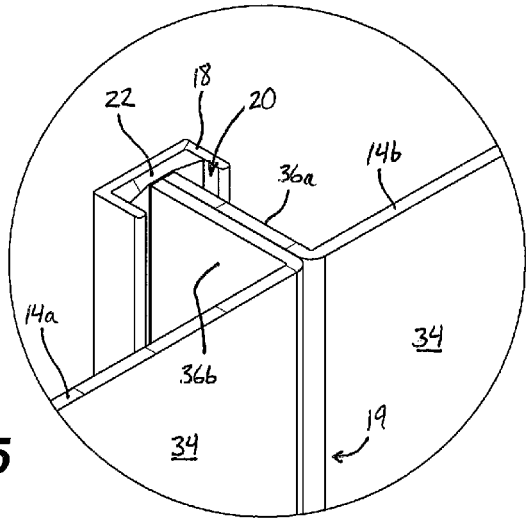
FIG. 5 is an enlarged perspective view of the same general area of the sign assembly as in FIG. 4, but showing only left and right sign face panels where they engage the elongate vertical channel member of the sign assembly.
Figure 10:
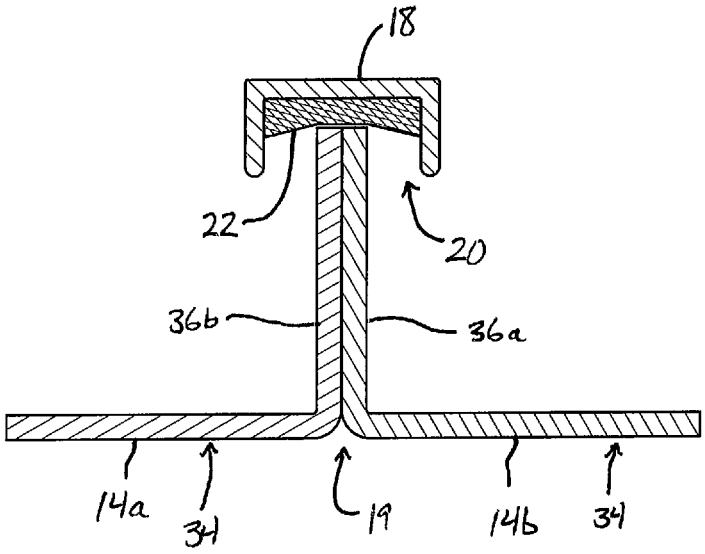
FIG. 10 is a sectional side or bottom elevation taken along line X-X in FIG. 3.

An elongate channel member 18 is placed at least location 19 two adjacent sign face panels 14 meet (or are in close proximity), and extends between upper frame member 16*c* and lower frame member 16*d* in generally vertical alignment, spaced between left frame member 16*a* and right frame member 16*b* (FIGS. 1, 1A, and 4). Channel member 18 has an upper end portion 18*a* that is joined to upper frame member 16*c*, and a lower end portion 18*b* that is joined to lower frame member 16*d*, the joining typically being accomplished by welding or bonding, or with mechanical fasteners, or the like. Channel member 18 has a generally U-shaped cross-section, such as shown in FIGS. 5 and 10, and defines a forward-facing channel 20 that is configured to simultaneously receive respective portions of the sign face panels 14 that meet or adjoin near the channel member 18, such as shown in FIGS. 5 and 10. Channel 20 has an elongate channel gasket 22 (FIGS. 4, 5, 8, and 10), which may include a self-adhesive backing for securing the gasket to channel member 18. Elongate channel gasket may be made from substantially any sufficiently soft, flexible, compressible, and weather-resistant material, such as natural or synthetic rubber or rubber-like material, for example. Channel gasket 22 is engaged by the sign face panels 14 when the panels are installed at framework 12, in order to provide a weather seal, as will be described in more detail below.

Figure 7:
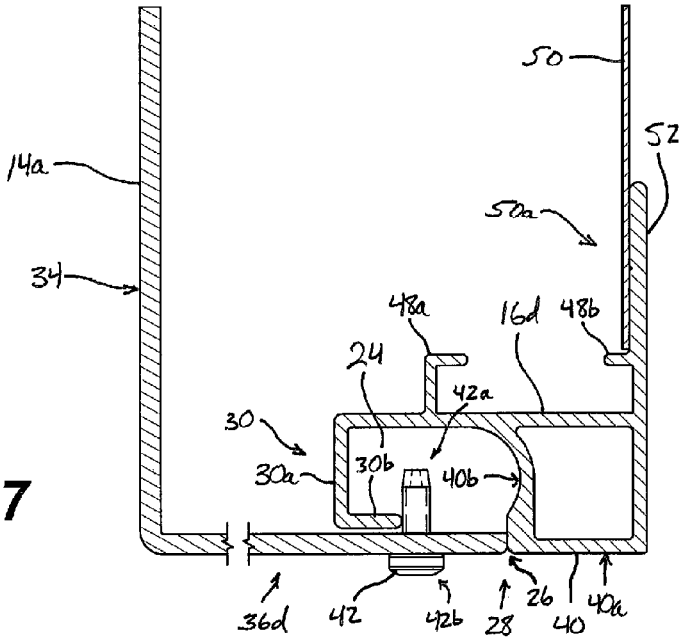
FIG. 7 is a sectional side elevation taken along line VII-VII in FIG. 3.
Figure 8:
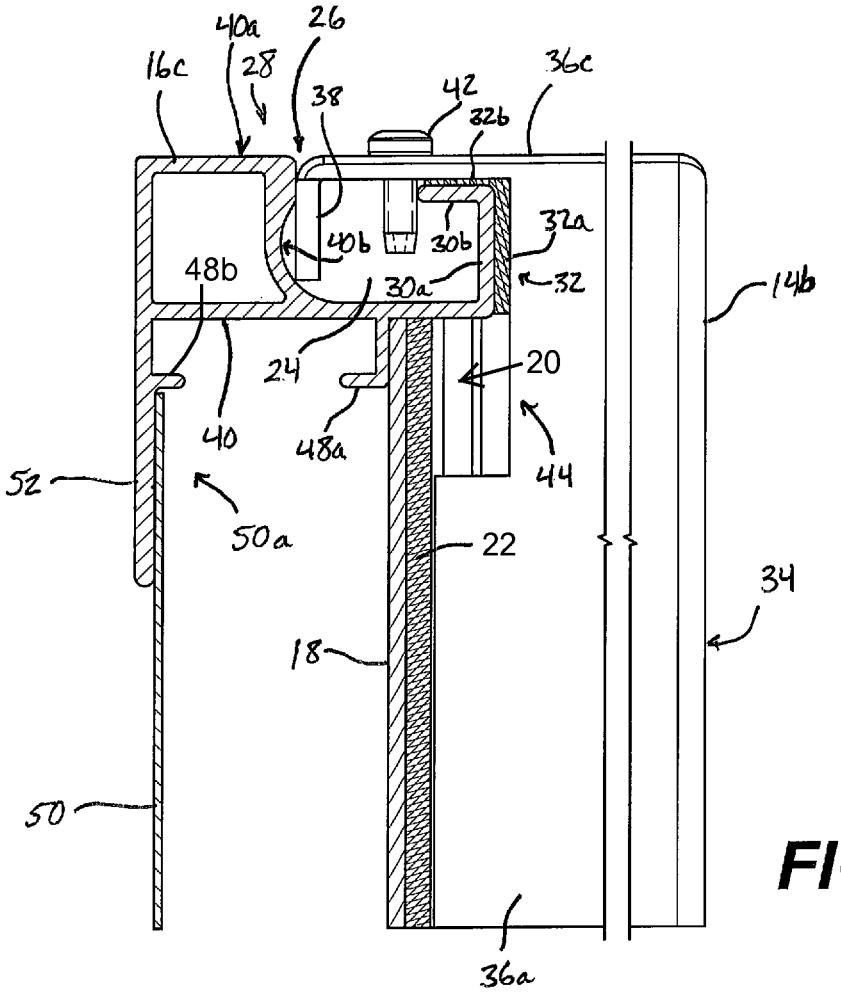
FIG. 8 is a sectional side or bottom elevation taken along lines VIII-VIII in FIG. 3.
Figure 9:
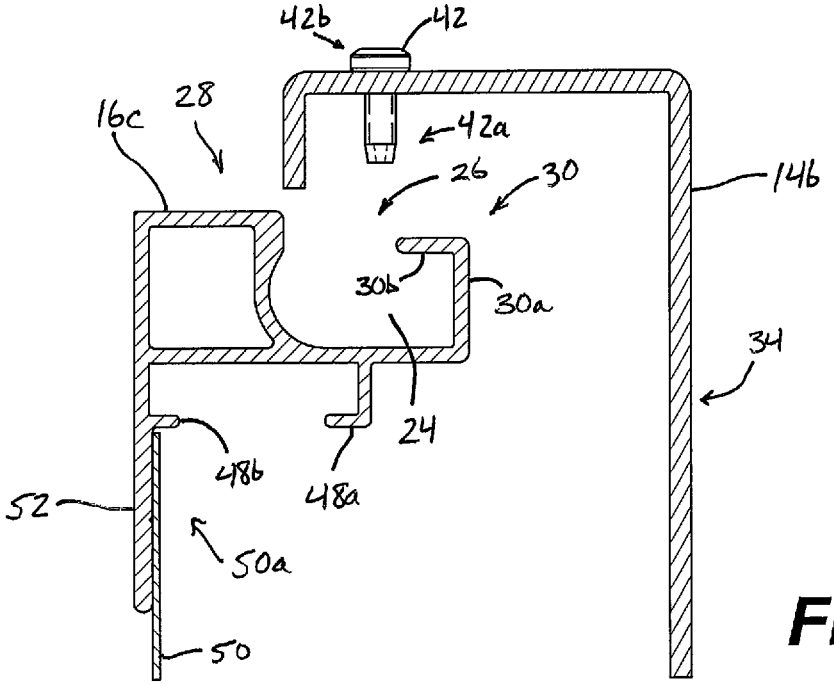
FIG. 9 is another section side or bottom elevation as in FIG. 8, but showing only the sign face panel, the upper frame member, and the support backing, with the sign face separated from the perimeter bracket.

An elongate fluid-conducting channel 24 is formed lengthwise along substantially the full length of each of the frame members 16 (FIGS. 6-9). Fluid-conducting channel 24 is open to an elongate slot 26 that is formed in an outboard side 28 of each perimeter frame member 16, such as shown in FIG. 9. Once sign assembly 10 is assembled and installed in an exterior location, any water that seeps or flows through elongate slot 26 and into fluid-conducting channel 24 will be directed along the frame member 16 and discharged at the sides and/or bottom of framework 12. For example, rainwater or wash water entering fluid-conducting channel 24 of upper frame member 16*c* will tend to flow left and/or right under gravity, toward the left and right frame members 16*a*, 16*b*, and will typically flow into upper ends of the respective fluid-conducting channels 24 of the left and right frame members 16*a*, 16*b*. Gravity carries the water down through the fluid-conducting channels 24 of the left and right frame members 16*a*, 16*b*, and the water is then discharged from the lower ends of the fluid-conducting channels 24 of the left and right frame members 16*a*, 16*b*, which act like rain gutters directing the water out of the bottom corners of the sign.

As best shown in FIGS. 6-9, the cross-section or profile of each frame member 16 includes a generally L-shaped forward portion 30 including a first leg 30*a* extending in an outboard direction (i.e., "up" as viewed in FIGS. 6, 8, and 9, and "down" as viewed in FIG. 7), and a second leg 30*b* extending in a rearward direction from a distal end portion of the first leg portion 30*a*. One or more generally L-shaped perimeter gaskets 32 (FIGS. 1A, 4, and 8) are positioned along the L-shaped forward portion 30 of at least the upper frame member 16*c*, proximate the location 19 of each channel member 18 where adjacent sign face panels 14 meet. Perimeter gaskets 32 provide an additional sealing function when they are engaged by the sign face panels 14, as will be described below. Perimeter gaskets 32 have first legs 32*a* and second legs 32*b* (FIGS. 4 and 8) that generally correspond to the respective first and second legs 30*a*, 30*b* of the L-shaped forward portion 30 of the upper frame member 16*c*, and may have a self-adhesive backing for securing perimeter gaskets 32 to the legs 30*a*, 30*b* of the L-shaped forward portion 30. Thus, wherever perimeter gaskets 32 are placed, they substantially cover the upper and forward surfaces (corresponding to the second leg 30*b* and first leg 30*a*, respectively) of the L-shaped forward portion 30 of the upper frame member 16*c*.

Each of sign face panels 14 has a forward-facing central display portion 34 that, in the illustrated embodiment, is generally rectangular in shape and formed from a substantially planar, smooth, and thin sheet material, such as sheet metal (FIGS. 1-10). A perimeter region of each sign face panel 14 substantially surrounds central display portion 34, and is made up of a left edge region 36*a*, a right edge region 36*b*, a top edge region 36*c*, and a bottom edge region 36*d* (collectively referred to hereinafter as "edge regions 36"), such as shown in FIG. 3. Edge regions 36 are perimeter portions of sign face panels 14 that are angled rearwardly from central display portion 34 (FIGS. 1A, 2, and 4-10). In the illustrated embodiment, edge regions 36 are substantially orthogonal to central display portion 34, and are unitarily formed therewith, such as via a bending or stamping operation on a single generally rectangular sheet of metal, such as aluminum or other sufficiently strong and thin material. Optionally, it is envisioned that sign face panels 14 could be formed of resinous plastic, or fiber-reinforced resinous plastic, such as in an injection molding operation or a sheet-forming operation.

Figure 6:
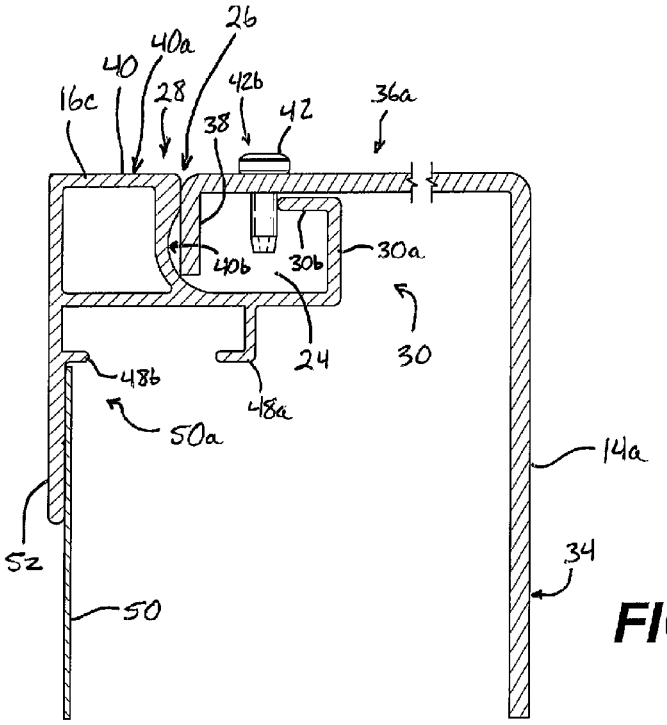
FIG. 6 is a sectional side elevation taken along line VI-VI in FIG. 3.

Top edge region 36*c* includes a downwardly-angled hook portion 38 at a distal end thereof (FIGS. 6, 8, and 9). When a given sign face panel 14 is coupled to framework 12, hook portion 38 extends downwardly into fluid-conducting channel 24 of upper frame member 16*c*, such as shown in FIGS. 6 and 8, so that an upper portion of sign face panel 14 cannot be inadvertently pulled forwardly away from upper frame member 16*c*. Thus, during installation of sign face panel 14 at framework 12, sign face panel 14 may be initially hung from upper frame member 16*c* simply by inserting, from above (FIG. 9), the hook portion 38 of top edge region 36*c* into fluid-conducting channel 24 of upper frame member 16*c*, which has already been secured to a generally vertical support surface, such as the exterior wall or façade of a building.

In the illustrated embodiment, left edge region 36*a*, right edge region 36*b*, and bottom edge region 36*d* of sign face panel 14 are substantially planar, and are configured to extend over (outboard) of the respective second legs 30*b* of the L-shaped portions 30 that form the forward-most portions of left frame member 16*a*, right frame member 16*b*, and lower frame member 16*d*, such as shown in FIG. 7 in which bottom edge region 36*d* extends outboard of the lower frame member's second leg 30*b*. This arrangement allows sign face panel 14 to be installed by initially hooking top edge region 36*c* onto upper frame member 16*c* with an upper portion of sign face panel 14 tilted rearwardly, and then pushing or allowing the lower portion of sign face panel 14 to pivot rearwardly (about a generally horizontal pivot axis near upper frame member 16*c*) until left edge region 36*a*, right edge region 36*b*, and bottom edge region 36*d* of sign face panel 14 are seated against their respective or corresponding left frame member 16*a*, right frame member 16*b*, and lower frame member 16*d*.

Each frame member 16 further includes a generally tubular section 40 at its outboard back corner (FIGS. 6-8), which adds strength and rigidity to the frame members. In the illustrated embodiment, tubular section 40 is generally square in shape and has an outboard surface 40*a* that forms the furthest-outboard surface of each frame member 16. In addition, a forward surface 40*b* defines a concave or scalloped shape running lengthwise along frame member 16. The concave shape of forward surface 40*b* may facilitate the pivoting movement of sign face panel 14 during installation (described above), or removal of sign face panel 14 from framework 12, by providing added clearance for hook portion 38 and the corner or bend where hook portion 38 begins at top edge region 36*c*. In addition, it will be appreciated that L-shaped portion 30 of each frame member 16 is set inboard from outboard surface 40*a* of tubular section 40, by a distance that is approximately equal to a thickness of sign face panel 14 at its respective edge regions 36, such as shown in FIGS. 6-8. In this way, when sign face panel 14 is fully installed at framework 12, the outermost perimeter surfaces of sign assembly 10 are substantially flush along each side of the sign.

A plurality of threaded fasteners 42 are positioned at spaced intervals through threaded bores that are established along each edge region 36 of sign face panel 14 (FIGS. 4 and 6-9). Fasteners 42 are movable between a fastening or tightened position (shown) and a releasing or loosened position. In the fastening position, distal end portions 42*a* of fasteners 42 extend into the fluid-conducting channels 24 of the respective frame member 16, and are positioned just rearwardly (or in contact with) a rearward nose or end of second leg 30*b* of the L-shaped portion 30 of frame member 16 (FIGS. 6-8). A wide head portion 42*b* of each fastener 42 remains positioned along the outboard surfaces of the edge regions 36 of each sign face panel 14 (FIGS. 2, 4, and 6-8). Fasteners 42 may be self-tapping screws or bolts, for example, or substantially any moveable fastener that can selectively engage and disengage fluid-conducting channels 24.

It is envisioned that at least the top and bottom edge regions 36*c*, 36*d* of any given sign face panel 14 will be fitted with fasteners 42 for engaging at least the upper and lower frame members 16*c*, 16*d*, respectively, and that any sign face panel 14 serving or positioned as the left-most or right-most panel (e.g., left and right sign face panels 14*a*, 14*b* of FIGS. 1 and 3), in a series of two or more adjacent panels in side-by-side arrangement, will also be equipped with fasteners 42 along its outboard (i.e., either left or right) edge region. For example, in the illustrated embodiment of FIGS. 1 and 3, left sign face panel 14*a* would have fasteners 42 disposed along each of its left edge region 36*a*, top edge region 36*c*, and bottom edge region 36*d* (engaging the left, upper, and lower frame members 16*a*, 16*c*, 16*d*, respectively), and right sign face panel 14*b* would have fasteners 42 disposed along each of its right edge region 36*b*, top edge region 36*c*, and bottom edge region 36*d* (engaging the right, upper, and lower frame members 16*b-d*, respectively).

In this arrangement, the right edge region 36*b* of left sign face panel 14*a*, and the left edge region 36*a* of right sign face panel 14*b*, would not be fitted with fasteners, since those edge regions meet at (and are received in) channel 20 in elongate channel member 18. Thus, each sign face panel 14 that is in a middle region of sign assembly 10 (i.e. not positioned as the left-most or right-most panel) would typically have fasteners at only its top edge region 36*c* and its lower edge region, while the left-most panel (e.g., left sign face panel 14*a*) would also have fasteners along its left edge region 36*a* and the right-most panel (e.g., right sign face panel 14*b*) would have fasteners along its right edge region 36*b*.

Thus, sign face panels 14 may be initially installed and supported at framework 12 with fasteners 42 in their releasing positions (or fully removed from their respective edge regions 36), with the engagement of hook portions 38 in the fluid-conducting channel 24 of upper frame member 16*c* ensuring that a given sign face panel 14 will not inadvertently fall away from framework 12 before fasteners 42 are installed. Once fasteners 42 are installed at least along the bottom edge region 36*d* of sign face panel 14 (or along at least the left or right edge region for a left-most or right-most sign face panel, as in panels 14*a*, 14*b*), the sign face panel 14 will be prevented from pivoting relative to framework 12 so that hook portion 38 will be prevented from disengaging upper frame member 16*c*. For additional security, it is envisioned that fasteners 42 would be secured to their fastening (tightened) positions along all exposed perimeter regions of each sign face panel 14, to ensure that each panel 14 is fully secured against loosening due to high wind loads or vibration. By leaving the fasteners 42 at top edge region 36*c* in their fastening position during pivoting movement of sign face panels 14, fasteners 42 will engage the rearward nose or end of second leg 30*b* of the L-shaped portion 30 of upper frame member 16*c* to ensure that sign face panel 14 cannot be jarred loose from upper frame member 16*c*, until the fasteners 42 at top edge region 36*c* are removed or substantially loosened.

Left and right side regions 36*a*, 36*b* of each sign face panel 14 define notched recess portions 44 at their upper ends, proximate top region 36*c* (FIGS. 4 and 8). Recess portions 44 provide clearance to receive L-shaped portion 30 of upper frame member 16 and the corresponding perimeter gasket 32 that is aligned with each elongate channel member 18. Any rainwater or other fluids that impact the upper surfaces of top region 36*c* and outboard surface 40*b*, in the vicinity of a joint or gap (at location 19) between adjacent sign face panels 14, may be expected to flow either into the fluid-conducting channel 24 of upper frame member 16, or along a front surface of perimeter gasket 32 and into channel 20 formed in elongate channel member 18. Fluid entering channel 20 will be carried downwardly by gravity, and will be prevented from entering the space behind each sign face panel 14 by elongate channel gasket 22, which is compressively engaged by rearward distal ends or edges of the left and right edge regions 36*a*, 36*b*, of adjacent right and left sign face panels 14*b*, 14*a*, respectively, such as shown in FIG. 5.

Optionally, sign assembly 10 includes a generally planar backing panel 50 that is configured to be securely coupled to a generally vertical support surface, such as the exterior wall or façade of a building. Backing panel 50 may be mounted to the support surface via mechanical fasteners (bolts, screws, nails, etc.) or via bonding, welding, or with substantially any other sufficiently secure and weather-resistant technique or hardware, including separate mounting brackets or substructure disposed between backing panel 50 and the support surface to which it is attached. Each of the frame members 16 includes an inboard rear mounting leg 52 that passes behind a respective perimeter edge portion 50*a* of backing panel 50 until a tab 48*b* of the frame member 16 contacts the backing panel (FIGS. 6-9). This arrangement ensures that any water passing behind upper frame member 16*c* will pass behind backing panel 50 without entering the space between backing panel 50 and sign face panels 14. Another tab 48*a* of frame member 16 is generally L-shaped, and provides a surface for at least temporarily securing two frame members together, which have been cut at angles (e.g. each at a 45-degree angles to form 90-degree corners of framework 12), during a welding or bonding or mechanical fastening step of the manufacturing process.

In the case of upper frame member 16*c*, the force of gravity may be sufficient to at least initially secure the frame member to backing panel 50 during installation. However, it is envisioned that inboard rear mounting legs 52 will be secured to the respective perimeter edge portions 50*a* of backing panel 50 with mechanical fasteners, bonding, welding, or other suitable technique or hardware. Optionally, framework 12 is joined to backing panel 50 prior to attaching backing panel to the substantially vertical support surface to which sign assembly 10 is being attached. Although backing panel 50 is illustrated and described primarily as a planar member that is typically mounted in parallel arrangement with a generally vertical support surface, it will be appreciated that framework 12 could be mounted directly to the support surface, or that a non-planar support surface and/or non-planar backing panel and/or non-planar framework and sign face panels may be used, without departing from the spirit and scope of the present invention.

The finished sign assembly 10 is typically fitted with a plurality of indicia members 54, which may be letters (as in FIG. 2), numbers, symbols, or designs made up of separate structures that are coupled to the forward-facing central display portions 34 of the sign face panels 14 and project outwardly therefrom. Typically, each sign face panel 14 will support one or more indicia members 54 out of a group of indicia members that extend across multiple sign face panels 14 in side-by-side arrangement. Optionally, the indicia members 54 may be internally lighted with electric lighting behind translucent outer panels, and configured to accommodate electrical wiring that may pass around or through openings formed in sign face panels 14.

Each indicia member 54 is typically coupled to one sign face panel 14 via removable fasteners, allowing for the removal and replacement of individual indicia without requiring a replacement sign face panel, and without requiring the removal of all sign face panels 14 of a given sign assembly 10, since each sign face panel 14 may be individually removed without disturbing or loosening the other sign face panels. Optionally, a serviceperson may even gain limited access to an interior portion or region of the sign assembly, including a rear surface of a given sign face panel 14, by loosening the fasteners 42 associated with that sign face panel and pivoting a lower portion of the panel 14 away from framework 12 while hook portion 38 remains engaged with upper frame member 16*c*. This serviceability may be particularly beneficial when the need arises to replace faulty electric lighting or a broken component in a single indicia member, for example.

As noted above, a further advantage of sign assembly 10 is that it is scalable to substantially any desired size. For example, frame members 16 may be extruded and cut to substantially any desired length, and it is envisioned that multiple extruded sections could be joined and sealed end-to-end if needed to provide a desire length without the transportation or handling difficulties that would be presented by a very long one-piece frame member. Likewise, sign face panels 14 may be formed to substantially any desired dimensions, and set side-by-side to achieve the desired finished width of the sign. In addition, the length of the edge regions 36 of each sign face panel 14 may be selected, such as in a manner represented by broken lines in FIGS. 6-8, to provide a desired depth dimension by which indicia members 54 are spaced from the support surface to which framework 12 is attached.

Thus, the sign assembly of the present invention permits the secure and weather-resistant display of substantially any sign or other indicia. Water channels and seals in the framework help ensure that the sign is resistant to water damage, and that it will also resist the buildup of moisture due to weather or washing. The sign assembly is configured for ease of maintenance, such as when replacing electrical components or changing sign lettering or other indicia, and many different types of service may be conducted on portions of the sign without requiring the time and expense of disassembling or removing other portions of the sign.

Changes and modifications in the specifically described embodiments can be carried out without departing from the principles of the present invention, which is intended to be limited only by scope of the appended claims, as interpreted according to the principles of patent law, including the doctrine of equivalents.

The invention claimed is:

1. A weather-resistant sign assembly comprising:

a plurality of perimeter frame members configured to be joined together to form a framework, said perimeter frame members including an upper frame member, a left frame member, and a right frame member;

an elongate fluid-conducting channel formed lengthwise along at least said upper frame member;

an elongate slot defined along an outboard surface of at least said upper frame member, wherein said elongate slot is open to said fluid-conducting channel;

left and right sign face panels positionable along said perimeter frame members in side-by-side arrangement, each of said sign face panels comprising (i) a forward-facing central display portion, (ii) respective left, right, top, and bottom edge regions that are angled rearwardly from said forward-facing central display portion, and (iii) a downwardly-angled hook portion at a distal end portion of said top edge region;

an elongate channel member having an upper end portion coupled to said upper frame member and a lower end portion spaced below said upper frame member, said channel member defining a forward-facing channel that is aligned with and configured to simultaneously receive respective distal edges of said right edge region of said left sign face panel and said left edge region of said right sign face panel;

a plurality of fasteners movably positioned along at least one of (i) said bottom edge region, (ii) said left edge region, and (iii) said right edge region of each of said left and right sign face panels, wherein said fasteners are moveable between a fastening position in which distal end portions of said fasteners engage a corresponding one or more of said frame members, and a releasing position in which said distal end portions of said fasteners substantially disengage said corresponding one or more of said frame members; and wherein said left and right sign face panels are securable to said framework when said downwardly-angled hook portions of said top edge regions of said left and right sign face panels are received in said fluid-conducting channels of said upper frame members, and said distal end portions of said fasteners are in said fastening position.

2. The sign assembly of claim 1, wherein each of said left frame member and said right frame member each comprises a respective one of said elongate fluid-conducting channels and a corresponding one of said elongate slots.

3. The sign assembly of claim 1, wherein each of said left, right, top, and bottom edge regions is generally orthogonal to said forward-facing central display portion of said left and right sign face panels.

4. The sign assembly of claim 1, wherein said elongate channel member is aligned substantially vertically and comprises a channel gasket disposed in said forward-facing channel, wherein when said left and right sign face panels are installed at said framework, said channel gasket is compressed by said distal edge of said right edge region of said left sign face panel and said distal edge of said left edge region of said right sign face panel.

5. The sign assembly of claim 1, wherein at least said upper frame member comprises a generally L-shaped forward portion having a first leg extending in an outboard direction, and a second leg extending in a rearward direction from a distal end portion of said first leg portion.

6. The sign assembly of claim 5, further comprising a perimeter gasket disposed at said generally L-shaped forward portion of said upper frame member, wherein said perimeter gasket is engaged by said top edge regions of said left and right sign face panels proximate said elongate channel member.

7. The sign assembly of claim 1, further comprising a backing panel for attachment to a substantially vertical support surface, wherein each of said frame members comprises an inboard rear leg portion configured to engage a respective perimeter edge portion of said backing panel.

8. The sign assembly of claim 1, further comprising a plurality of indicia members coupled to said forward-facing central display portions of said left and right sign face panels via mechanical fasteners, said indicia members comprising at least one chosen from (i) lettering, (ii) symbols, and (iii) internally-lighted indicia.

9. The sign assembly of claim 1, wherein said perimeter frame members further comprise a lower frame member disposed between said left frame member and said right frame member, whereby said framework is generally rectangular in shape, and wherein said lower end portion of said elongate channel member is coupled to said lower frame member.

10. The sign assembly of claim 9, wherein said plurality of fasteners are movably positioned along said bottom edge region of each of said left and right sign face panels, wherein said fasteners are moveable between a fastening position in which distal end portions of said fasteners engage said lower frame member, and a releasing position in which said distal end portions of said fasteners substantially disengage said lower frame member.

11. A weather-resistant sign assembly comprising:

a plurality of perimeter frame members configured to be joined together to form a generally rectangular framework, said perimeter frame members including an upper frame member, a lower frame member, a left frame member, and a right frame member;

an elongate fluid-conducting channel formed lengthwise in each of said perimeter frame members;

an elongate slot defined along an outboard surface of each of said perimeter frame members, wherein said elongate slot is open to said fluid-conducting channel;

left and right sign face panels positionable along said perimeter frame members in side-by-side arrangement, each of said sign face panels comprising (i) a forward-facing central display portion, (ii) respective left, right, top, and bottom edge regions that are angled rearwardly from said forward-facing central display portion, and (iii) a downwardly-angled hook portion at a distal end of said top edge region;

an elongate vertical channel member having upper and lower end portions coupled to said upper and lower frame members, respectively, and defining a forward-facing substantially vertical channel that is aligned with and configured to simultaneously receive respective distal edges of said right edge region of said left sign face panel and said left edge region of said right sign face panel;

a plurality of fasteners movably positioned at said bottom edge regions of said left and right sign face panels, wherein said fasteners are moveable between a fastening position in which distal end portions of said fasteners extend into said fluid-conducting channel of said lower frame member, and a releasing position in which said distal end portions of said fasteners substantially disengage said fluid-conducting channel of said lower frame member; and wherein said left and right sign face panels are securable to said framework when said downwardly-angled hook portions of said top edge regions of said left and right sign face panels are received in said fluid-conducting channels of said upper frame members, and said distal end portions of said fasteners are in said fastening position.

12. The sign assembly of claim 11, further comprising a channel gasket disposed in said substantially vertical channel of said vertical channel member, wherein said channel gasket is compressed between a portion of said vertical channel member and said distal edge of said right edge region of said left sign face panel and said distal edge of said left edge region of said right sign face panel.

13. The sign assembly of claim 11, wherein said upper frame member comprises a generally L-shaped forward portion having a first leg extending in an outboard direction, and a second leg extending in a rearward direction from a distal end portion of said first leg portion.

14. The sign assembly of claim 13, further comprising a perimeter gasket disposed at said generally L-shaped forward portion of said upper frame member, wherein said perimeter gasket is engaged by said top edge regions of said left and right sign face panels proximate said elongate vertical channel member.

15. The sign assembly of claim 14, wherein said perimeter gasket comprises an L-shape with first and second legs generally corresponding to said first and second legs of said L-shaped forward portion of said upper frame member.

16. The sign assembly of claim 11, further comprising a backing panel for attachment to a substantially vertical support surface, wherein each of said frame members comprises a rear portion configured to engage said backing panel.

17. The sign assembly of claim 16, wherein said backing panel comprises a generally planar member.

18. The sign assembly of claim 11, further comprising a plurality of indicia members coupled to said forward-facing central display portions of said left and right sign face panels.

19. The sign assembly of claim 11, wherein said indicia members comprise at least one chosen from (i) lettering, (ii) symbols, and (iii) internally-lighted indicia, and wherein said indicia members are coupled to said forward-facing central display portions via mechanical fasteners.

20. The sign assembly of claim 11, wherein said perimeter frame members and said elongate vertical channel member comprises an extruded section configured to be cut to a desired length.

* * * * *